United States Patent [19]

Myreen

[11] 4,184,540

[45] Jan. 22, 1980

[54] ROTARY HEAT EXCHANGER

[75] Inventor: Bertel Myréen, Åbo, Finland

[73] Assignee: RA-Shipping Ltd. Oy, Pargas, Finland

[21] Appl. No.: 861,555

[22] Filed: Dec. 16, 1977

[30] Foreign Application Priority Data

Dec. 16, 1976 [FI] Finland ..... 763619

[51] Int. Cl.[2] ..... F28F 00/00; F28D 11/08

[52] U.S. Cl. ..... 165/92; 165/DIG. 5; 165/88

[58] Field of Search ..... 165/92, 86, 88, 89, 165/159, 144

[56] References Cited

U.S. PATENT DOCUMENTS

| | | | |
|---|---|---|---|
| 1,828,799 | 10/1931 | Carlson | 165/92 |
| 2,205,431 | 6/1940 | Olson | 165/92 |
| 3,182,719 | 5/1965 | Christ | 165/159 |
| 3,351,131 | 11/1967 | Berthold | 165/159 |
| 3,852,892 | 12/1974 | Sheehan | 165/92 |

FOREIGN PATENT DOCUMENTS

| | | | |
|---|---|---|---|
| 1263036 | 3/1968 | Fed. Rep. of Germany | 165/86 |
| 1166095 | 11/1958 | France | 165/92 |
| 313780 | 6/1929 | United Kingdom | 165/92 |

*Primary Examiner*—Charles J. Myhre
*Assistant Examiner*—Carl Stuart Miller
*Attorney, Agent, or Firm*—Browdy and Neimark

[57] ABSTRACT

Heat exchanger for the heating or cooling of a liquid, in particular of a suspension, comprises of a container provided with an inlet and an outlet and wherein there is disposed at least one rotatably mounted, substantially horizontal heat exchange unit having two end pieces between which heat transfer pipes have been fitted, and a conduit for conducting a heat-accepting or heat-releasing fluid through the end pieces and the heat transfer pipes of said heat exchange unit, a central tube concentrically disposed in relation to the rotational axis of the heat exchange unit between the end pieces among the heat transfer pipes, the diameter of the central tube being not less than 40% of the greatest distance between any two heat transfer pipes, measured at right angles to the rotational axis and that at least the lower edge of the outlet from the container in which the heat exchanger unit has been disposed being located at a level lower than the topmost part of the central tube so that the latter can be held above the free liquid level in the container.

6 Claims, 6 Drawing Figures

ROTARY HEAT EXCHANGER

FIELD OF THE INVENTION

The present invention ralates to a heat exchanger wherein a liquid, in particular a suspension, is heated or cooled by causing the suspension to flow through a container in which a substantially horizontal heat exchange unit consisting of a pipe set has been rotatably mounted.

Heat exchange between two fluids, one of them being heated or vapourised and the other being cooled or condensed, usually takes place in surface heat exchangers in which both fluids are caused to flow past a heat transfer wall, through which heat is transferred as a consequence of temperature differences between the fluids, and which prevent mixing of the fluids. In view of obtaining efficient heat transfer between a fluid in a surface heat exchanger and its heat transfer wall, a relative velocity between wall and fluid is required. This is normally accomplished by allowing the fluid to flow through sufficiently narrow closed flow ducts which are confined by the heat transfer wall in part at least. If the fluid is a suspension with a relatively high content of solid particles, it will be viscid whereby a high inlet pressure has to be generated by means of a pump in order to transport the suspension through the flow passages of the heat exchanger. There is even a high risk that the flow passages are blocked by the solid material present in the suspension, and likewise the risk that this material within a short time may form a coat on the heat transfer wall detrimental to heat flow.

It is well known that a relative velocity of the suspension with respect to the heat transfer wall may also be produced in that with the aid of a drive the heat transfer wall is set in motion within a stationary or slowly flowing suspension. In such case a pump is not absolutely necessary to transport the suspension through the heat exchange apparatus.

The Swedish Pat. No. 384,569 discloses a heat exchanger featuring a rotating heating loop. This loop then rotates in a container totally filled with the heat-receiving fluid. In case this fluid is viscid and there are several layers of tubes in radial direction in the rotating tube set, the tube set will also tend to impart a rotation to the contents of the container, whereby the relative velocity of contents and tube set with reference to each other, which is necessary for heat transfer, will be low.

The object of the present invention is to provide a heat exchanger fitted with a rotating tube set wherein the rotation of the container's contents is prevented, and wherein a high relative velocity is obtained even between a viscid suspension and the heat transfer wall and, moreover, in such a manner that it is easy to clean the heat transfer wall of deposits.

SUMMARY OF THE INVENTION

According to the invention a central tube has been concentrically disposed in relation to the rotational axis of the heat exchange unit between the end pieces among the heat transfer tubes, the diameter of the central tube being not less than 40% of the largest distance between any two heat transfer tubes, measured at right angles to the rotational axis, at least the lower edge of the outlet from the container being located at a level lower than the topmost part of the central tube, so that the latter can be kept above the free liquid level in the container.

DESCRIPTION OF THE PREFERRED EMBODIMENTS

Figure 1:
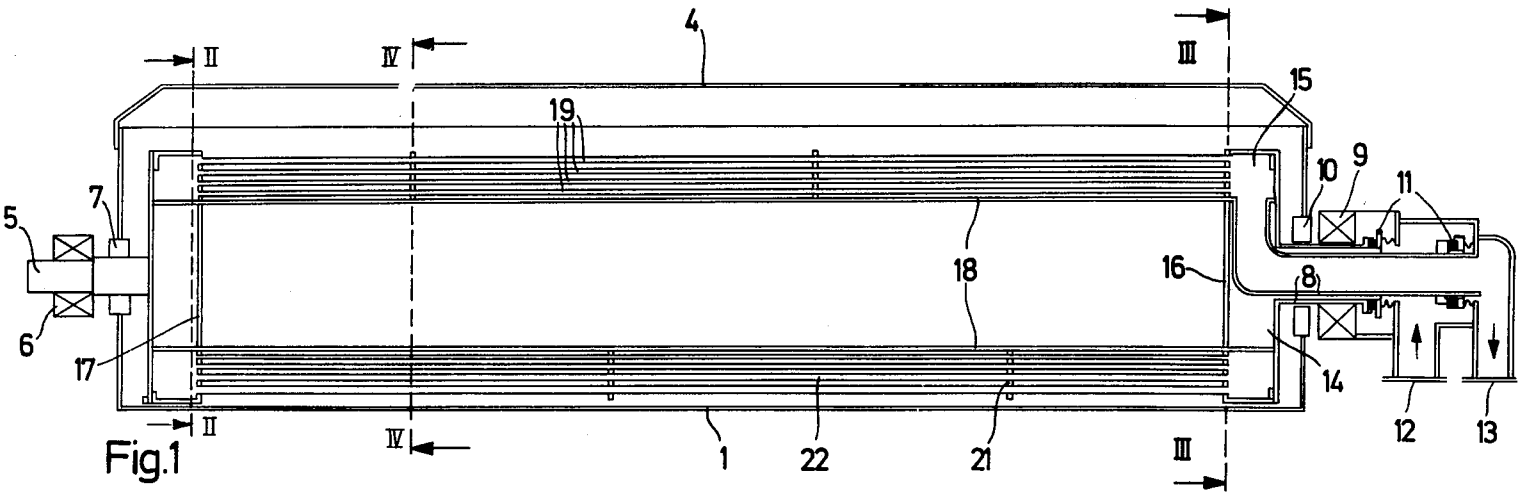
FIG. 1 illustrates the apparatus in the form of a schematic vertical section carried through the rotational axis of the heat exchanger unit.
Figure 6:
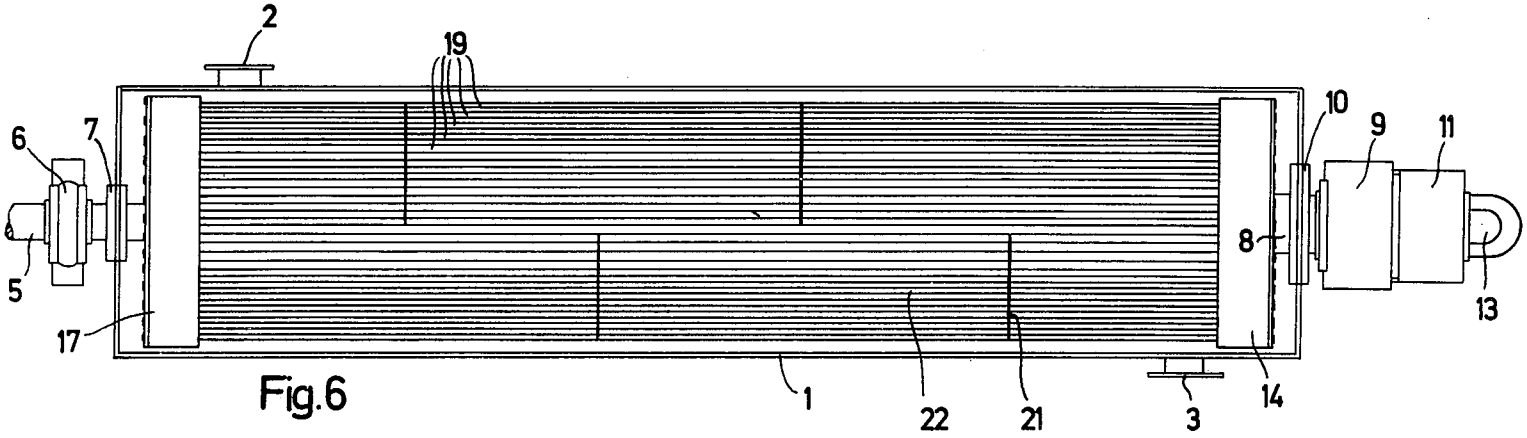
FIG. 6 shows the apparatus of FIG. 1, schematically viewed from above.
Figure 3:
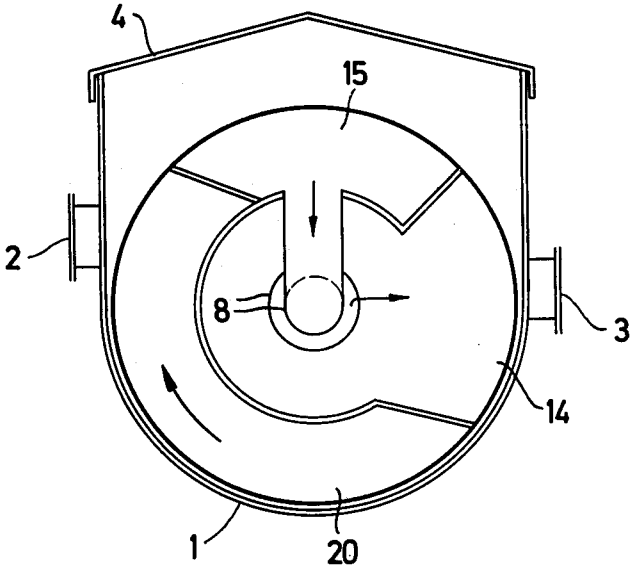
FIGS. 2 and 3 show the same means, presented in a schematic vertical section at right angles to the rotational axis along the lines indicated by II—II and III—III respectively in FIG. 1.

In these Figures, 1 is the container through which the suspension is caused to flow with inflow through the inlet 2 and withdrawal by the outlet 30. The container may be opened the top or provided with cover 4. Within the container the rotating heat exchange unit has been accommodated, its shaft 5 on the drive side being carried in the bearing 6 and sealed against the container within the seal 7. On the opposite side, the heat exchange unit has a double jacketed hollow shaft 8, which is carried on the outside of the container in the bearing 9 and has been sealed against the container within the seal 10. The hollow shaft terminates in a double packing box 11, which has been connected to the inlet 12 and outlet 13 of the heat exchange fluid. This fluid may be, for instance, cooling water, hot water or condensing steam.

Figure 2:
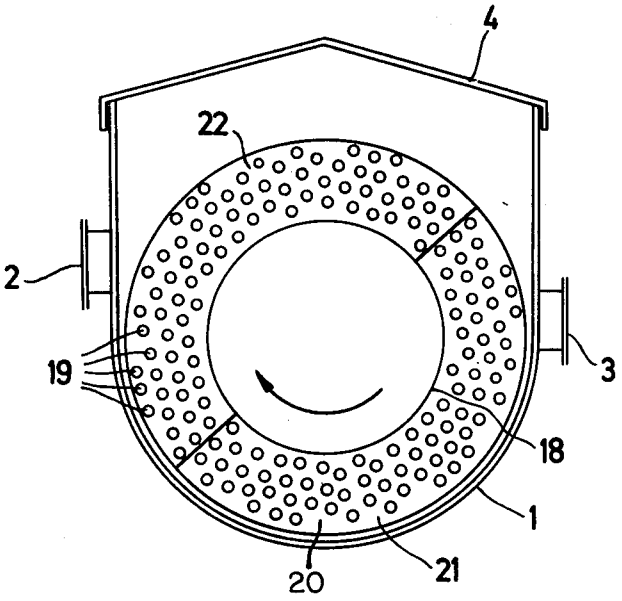

The inlet 12 and outlet 13 communicate by the hollow shaft 8 in open connection each with one of the mutually separated compartments 14 and 15 in an end piece 16. On the driven side of the apparatus an equivalent end piece 17 is found. These end pieces are connected to an air-filled central tube 18 disposed concentrically around the rotational axis. On the outside of the central tube between the end pieces 16 and 17 are a plurality of pipe lines 19, which constitute open connections between the end pieces and the compartments 14, 15 and 20 separated by means of partitions, and which arrangement compels any liquid introduced into the end piece to flow through series-connected pipe bundles of pipe lines 19 connected in parallel. In an apparatus such as is shown in FIG. 2, one has four such pipe bundles with about 40 pipe lines each. Other numbers of pipe lines and of pipe bundles may naturally also be contemplated. In view of bracing the pipe lines 19 which constitute the heat transfer wall, and also in order to guide the flow course within the apparatus, the apparatus comprises supporting plates 21 affixed to the central tube 18, these plates having cut-outs so as to cause each plate to brace or support part of the pipes 19 and at the same time to leave open another part 22, through which the suspension may flow in axial direction. By arranging the cut-outs 22 of different supporting plates to be continuous with different pipes 19, all these pipes can be braced. In one of the embodiments, the cut-outs 22 may be totally omitted.

The container 1 is cylindrical in its lower part with merely a narrow gap between the outermost of pipes 19 and the container wall. Upwardly from the plane of the rotational axis the walls of the container are preferably vertical, so that the rotating part may be lifted out of the container if required.

Figure 4:
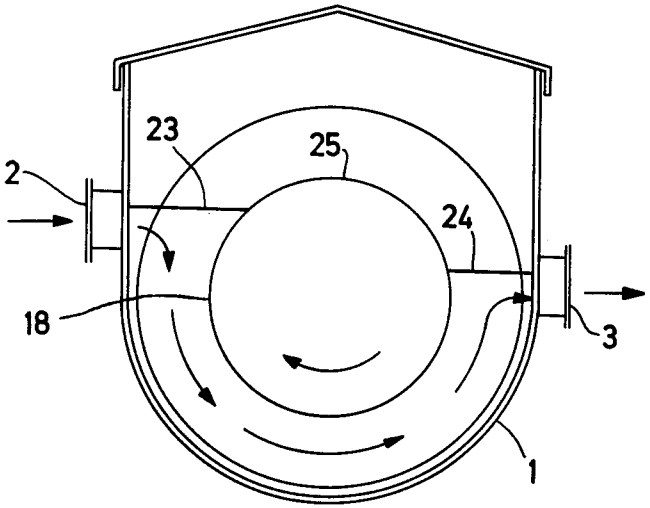

The structure supporting the apparatus has not been depicted in FIGS. 1–6. It is of a conventional kind and it is so constructed that the axis of the heat exchange unit is horizontal or has an inclination so that the end of the apparatus where the inlet of the suspension is located has a higher elevation than the outlet end. The apparatus operates in a continuous steady state in one of two alternative ways. According to one of these ways, the heat exchange unit rotates within the container in a direction such that the pipe lines move upwardly on that side where the inlet 2 of the suspension is located. This is illustrated by FIG. 4. Since the outlet 3 of the suspension is located at an elevation lower than the inlet 2, partly due to its placement in the container 1 and partly owing to the potential inclination of the apparatus with reference to the horizontal plane, the suspension will only partially fill the container 1 and there will be a free suspension surface in the apparatus. This free suspension level will, as a result of the heat exchange unit's rotation, adjust itself at a higher level 23 on the suspension inlet side from the central tube 18 compared with the level 24 on the opposite side. This difference in level produces a flow of suspension at right angles to the pipes 19 and to their direction of motion. The flow in axial direction is adjusted by means of the cut-outs 22 in the supporting plates 21 and the suspension is withdrawn, for instance, by free overflow through the outlet 3 at the other end of the apparatus.

By appropriate choice of the distances between pipes 19 and of the heat exchanger unit's peripheral velocity, the pressure drop encountered as the suspension flows at right angles to the pipes 19 may be balanced by the static differential pressure which arises from the difference in level between surfaces 23 and 24, in such manner that the surface 23 will not rise past the highest point 25 of the central tube 18. The suspension is hereby prevented from rotating along with the heat transfer pipes 19, and one achieves the relative velocity which is necessary for efficient heat transfer, between the heat transfer pipes 19 and the suspension. In addition to this function, the central tube affords requisite rigidity to the rotating part of the apparatus.

Figure 5:
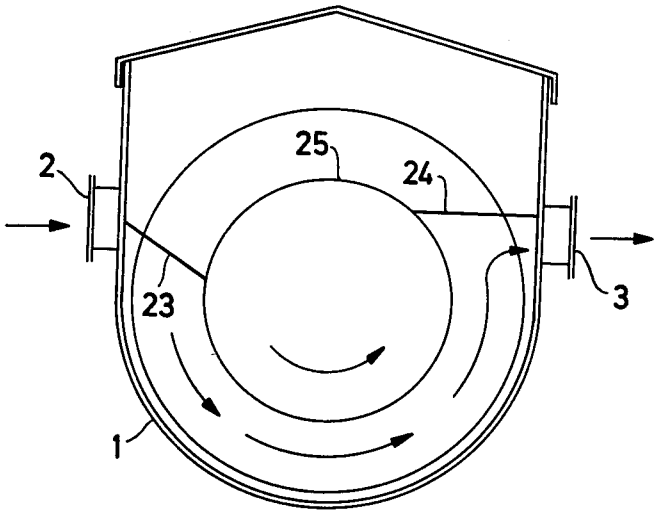
FIGS. 4 and 5 show a vertical section along the line indicated by IV—IV of FIG. 1, with the movement of the suspension in the apparatus indicated in them.

The second mode of use is illustrated by FIG. 5. According to this mode of use, the heat exchange unit rotates in such direction within the container that the pipe lines 19 move downwardly on the side where the inlet 2 of the suspension is located. By effect of the rotation, the free surface of the suspension 23 on the suspension outlet side from the central tube 18 will be at an elevation higher than the free surface 24 on the opposite side. In this case too, it is possible by appropriate selection of peripheral velocity of the heat exchanger, to make the surface 23 adjust itself to remain below the highest point 25 of the central tube, whence follows that the suspension cannot rotate in the apparatus with a velocity identical to that of the heat exchange unit. In this application, too, the supporting plates 21 prevent free axial flow of the suspension from inlet to outlet. In an apparatus with this particular direction of rotation the outlet may be located on the same elevational level as the inlet.

It has been assumed in the preceding functional descriptions that the inlet 2 and outlet 3 of the suspension are chutes with a free surface. However, the inlet and outlet may equally be closed pipelines, in which connection modified places of connection and which permit the maintaining of a free liquid level in the container are possible without diversion from the scope of the invention.

The apparatus may also be used to warm and cool liquids containing no solid particles. The heat transfer pipes are easy to clean on the side which is in contact with the suspension, even without any need to empty the apparatus, since all heat transfer pipes can be brought into a position in which they are above the suspension surface.

What is claimed is:

1. Heat exchanger for the heating or cooling of a liquid, in particular a suspension having a high content of solid particles, comprising a container having an inlet and an outlet for said liquid positioned at opposite sides and opposite ends of said container, at least one substantially horizontal heat exchange unit being rotatably mounted in said container and comprising two end chambers communicating through a plurality of pipes arranged in a generally annular configuration, said container having below a horizontal plane through the rotational axis of said heat exchange unit a circular cylindrical shape to closely conform to said heat exchange unit, means for feeding a heat exchange fluid through said end chambers and said plurality of pipes, a central tube extending concentrically in relation to said rotational axis between said end chambers and being closed-off from them and from said container, said central tube having a diameter not less than 40% of the greatest distance between any two pipes of said heat exchange unit measured at right angles to said rotational axis, and said outlet from said container having a lower edge at a level lower than the uppermost portion of said central tube to maintain said uppermost portion above the free surface level of said liquid in said container.

2. Heat exchanger according to claim 1 in which the heat transfer fluid is conducted in and out through one and the same double jacketed hollow shaft at one end of the container.

3. Heat exchanger according to claim 1, in which the rotating unit has supporting plates positioned at right angles to the rotational axis and affixed thereto and which support the heat transfer pipes and at the same time guide the flow of the liquid or suspension present on the outside of the pipes mainly at right angles to the pipes and that these bracing plates have an open portion allowing flow in axial direction.

4. Heat exchanger according to claim 1, in which the heat exchanger has a supporting structure which imparts to the heat exchanger an inclination such that its rotational axis is inclined at such an angle against the horizontal plane that the fluid flowing through the container on the outside of the heat exchange unit reaches substantially equally high up by the central tube on the latter's whole length when the heat exchange unit is rotating.

5. Heat exchanger according to claim 1, in which the inlet is on that side of the container where the heat transfer pipes are ascending and the outlet is at a lower elevation on the opposite side.

6. Heat exchanger according to claim 1, in which the inlet is on that side of the container where the heat exchanger pipes are descending and the outlet is at the same elevation on the opposite side.

* * * * *